US012410697B2

(12) United States Patent
Crane

(10) Patent No.: US 12,410,697 B2
(45) Date of Patent: Sep. 9, 2025

(54) DOWNHOLE SAND AND GAS SEPARATOR

(71) Applicant: Endurance Lift Solutions, LLC, Gainesville, TX (US)

(72) Inventor: Don Crane, Snyder, TX (US)

(73) Assignee: Endurance Lift Solutions, LLC, Gainesville, TX (US)

( * ) Notice: Subject to any disclaimer, the term of this patent is extended or adjusted under 35 U.S.C. 154(b) by 0 days.

(21) Appl. No.: 18/392,175

(22) Filed: Dec. 21, 2023

(65) Prior Publication Data

US 2025/0207492 A1 Jun. 26, 2025

(51) Int. Cl.

*E21B 43/38* (2006.01)
*E21B 43/12* (2006.01)
*E21B 43/34* (2006.01)

(52) U.S. Cl.

CPC ..... *E21B 43/385* (2013.01); *E21B 43/121* (2013.01); *E21B 43/128* (2013.01); *E21B 43/35* (2020.05); *E21B 43/38* (2013.01)

(58) Field of Classification Search

CPC ..... E21B 43/35
See application file for complete search history.

(56) References Cited

U.S. PATENT DOCUMENTS 1,379,477 A * 5/1921 Perry ..... F04B 47/005 166/105.1
1,507,927 A * 9/1924 Miller ..... F04B 53/1037 210/458
1,651,968 A * 12/1927 Claudius ..... E21B 43/38 210/123
1,655,817 A * 1/1928 Marsh ..... E21B 43/38 166/105.5
1,672,687 A * 6/1928 Penrod ..... E21B 43/38 417/434
2,029,323 A * 2/1936 Jones ..... E21B 43/35 166/105.1
2,429,043 A * 10/1947 Barnhart ..... E21B 43/38 166/105.1
2,440,651 A * 4/1948 Bell ..... E21B 17/042 285/333
3,289,608 A * 12/1966 Laval, Jr. ..... E21B 43/35 55/455
4,900,433 A * 2/1990 Dean ..... E21B 43/36 210/512.3
5,295,537 A * 3/1994 Trainer ..... E21B 43/38 166/105.3

(Continued)

*Primary Examiner* — Blake Michener
(74) *Attorney, Agent, or Firm* — Hall Estill Law Firm

(57) ABSTRACT

A downhole separator for separating a three-phase fluid produced in an oil or gas well. The downhole separator including a tubular body and a radial directed opening in an uphole end of the tubular body for allowing the three-phase fluid to enter the downhole separator while also permitting a gas component of the three-phase fluid to exit the downhole separator. The downhole separator also including a dip tube disposed inside the tubular body for delivering a primarily liquid component of the three-phase fluid to be processed and a first annulus area disposed between the dip tube and the tubular body. A method of separating components of a three-phase fluid produced in an oil or gas well. The method includes the step of pumping the three-phase fluid into a downhole separator to separate the three-phase fluid into the separate components.

15 Claims, 3 Drawing Sheets

(56) References Cited

U.S. PATENT DOCUMENTS

| | | | | | |
|---|---|---|---|---|---|
| 5,411,088 | A * | 5/1995 | LeBlanc | B01D 19/0042 | 166/105.1 |
| 5,553,669 | A * | 9/1996 | Trainer | B01D 29/48 | 166/105.1 |
| 5,653,286 | A * | 8/1997 | McCoy | E21B 43/38 | 166/105.5 |
| 6,039,121 | A * | 3/2000 | Kisman | E21B 43/38 | 166/372 |
| 6,481,499 | B2 * | 11/2002 | Lopes | E21B 43/35 | 166/250.03 |
| 7,377,314 | B2 * | 5/2008 | Gonzalez | E21B 43/38 | 166/105.5 |
| 8,136,600 | B2 * | 3/2012 | Fowler | E21B 43/36 | 166/267 |
| 10,408,035 | B2 * | 9/2019 | Kennedy | E21B 43/121 | |
| 11,525,348 | B2 * | 12/2022 | Xiao | E21B 43/38 | |
| 2001/0004017 | A1 * | 6/2001 | Lopes | E21B 43/38 | 96/204 |
| 2004/0244987 | A1 * | 12/2004 | Crews | E21B 43/35 | 166/105 |
| 2016/0333681 | A1 * | 11/2016 | Mazzanti | E21B 43/35 | |
| 2021/0215024 | A1 * | 7/2021 | Brown | E21B 17/1078 | |
| 2021/0324722 | A1 * | 10/2021 | Xiao | E21B 43/38 | |
| 2022/0003103 | A1 * | 1/2022 | Xiao | E21B 43/121 | |
| 2022/0381129 | A1 * | 12/2022 | Ellithorp | E21B 43/38 | |
| 2023/0064086 | A1 * | 3/2023 | Fotiades | E21B 43/34 | |

* cited by examiner

DOWNHOLE SAND AND GAS SEPARATOR

STATEMENT REGARDING FEDERALLY SPONSORED RESEARCH OR DEVELOPMENT

Not applicable.

CROSS-REFERENCE TO RELATED APPLICATIONS

Not applicable.

BACKGROUND OF THE DISCLOSURE

1. Field of the Invention

The present disclosure relates to a downhole separator for separating gas and sand (or other solid material) from fluids produced in oil and gas wells.

2. Description of the Related Art

Producing dynamic wells in which both gases and solids are present can create certain challenges. When gases and solids are produced with fluids from a well and delivered to other oil and gas equipment, such as pumps, the run life of the other oil and gas equipment can be shortened. Typical solutions to this problem are accomplished with complicated and expensive equipment.

Accordingly, there is a need for a separator that can efficiently separate gas and solids from fluids produced in oil and gas wells.

SUMMARY OF THE DISCLOSURE

The present disclosure is directed to a downhole separator for separating a three-phase fluid produced in an oil or gas well. The downhole separator including a tubular body and a radial directed opening in an uphole end of the tubular body for allowing the three-phase fluid to enter the downhole separator while also permitting a gas component of the three-phase fluid to exit the downhole separator. The downhole separator also including a dip tube disposed inside the tubular body for delivering a primarily liquid component of the three-phase fluid to be processed and a first annulus area disposed between the dip tube and the tubular body.

The present disclosure also directed to a method of separating components of a three-phase fluid produced in an oil or gas well. The method includes the step of pumping the three-phase fluid into a downhole separator to separate the three-phase fluid into the separate components.

DETAILED DESCRIPTION OF THE DISCLOSURE

Figure 1:
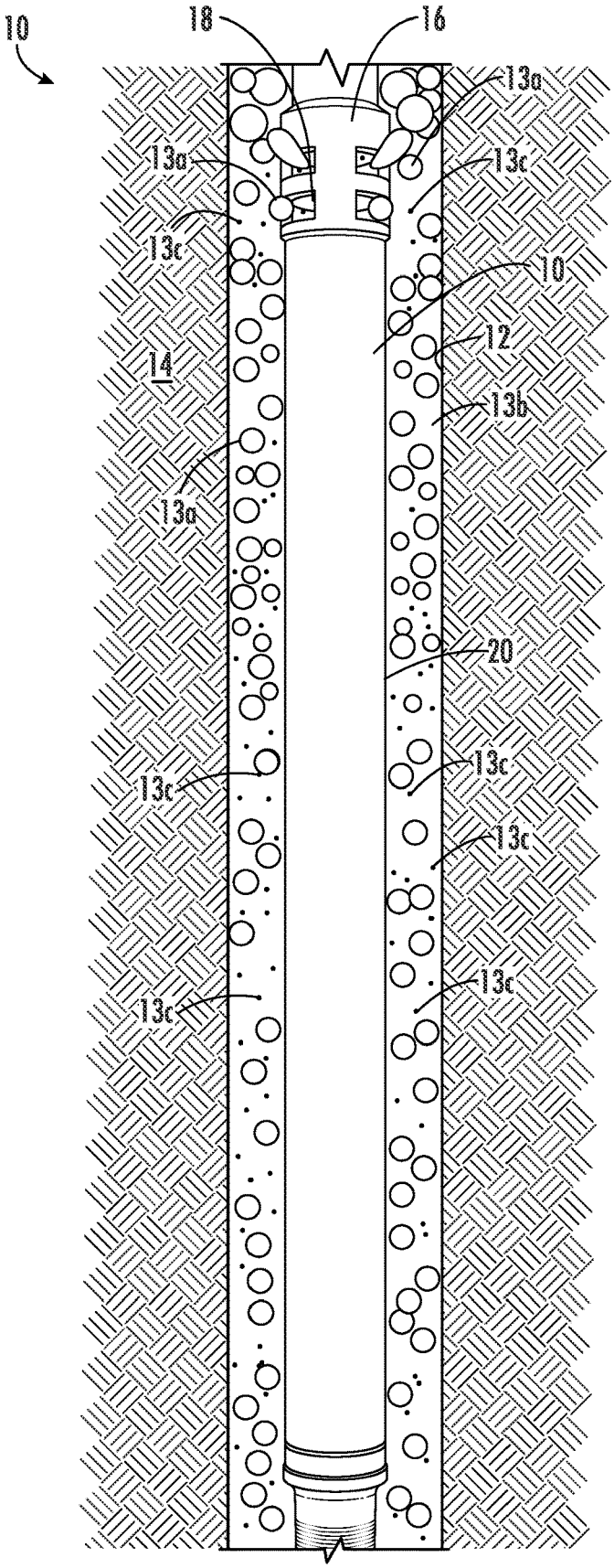
FIG. 1 is a side elevation view of a downhole separator constructed in accordance with the present disclosure.
Figure 2:
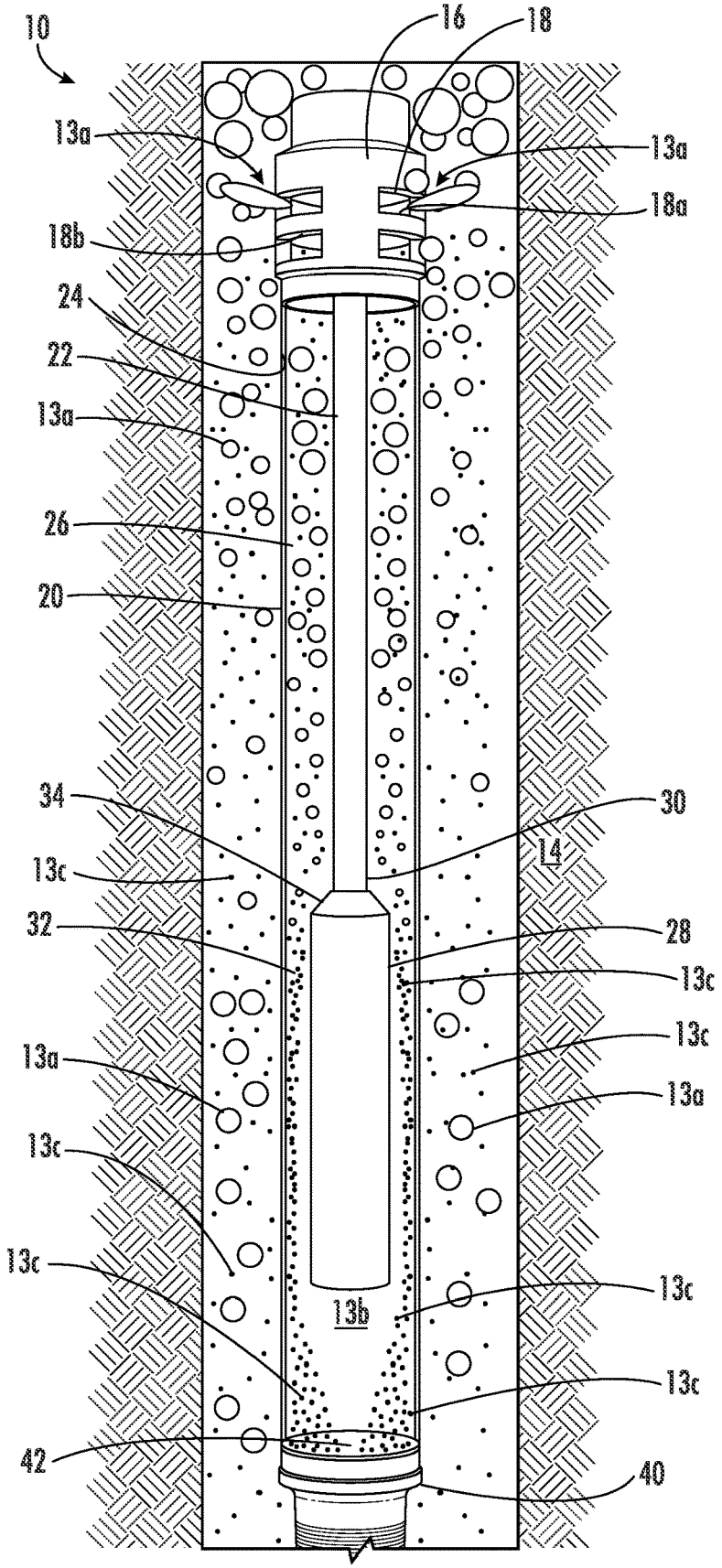
FIG. 2 is a partial cross-section and partial side elevation view of the downhole separator constructed in accordance with the present disclosure.
Figure 3:
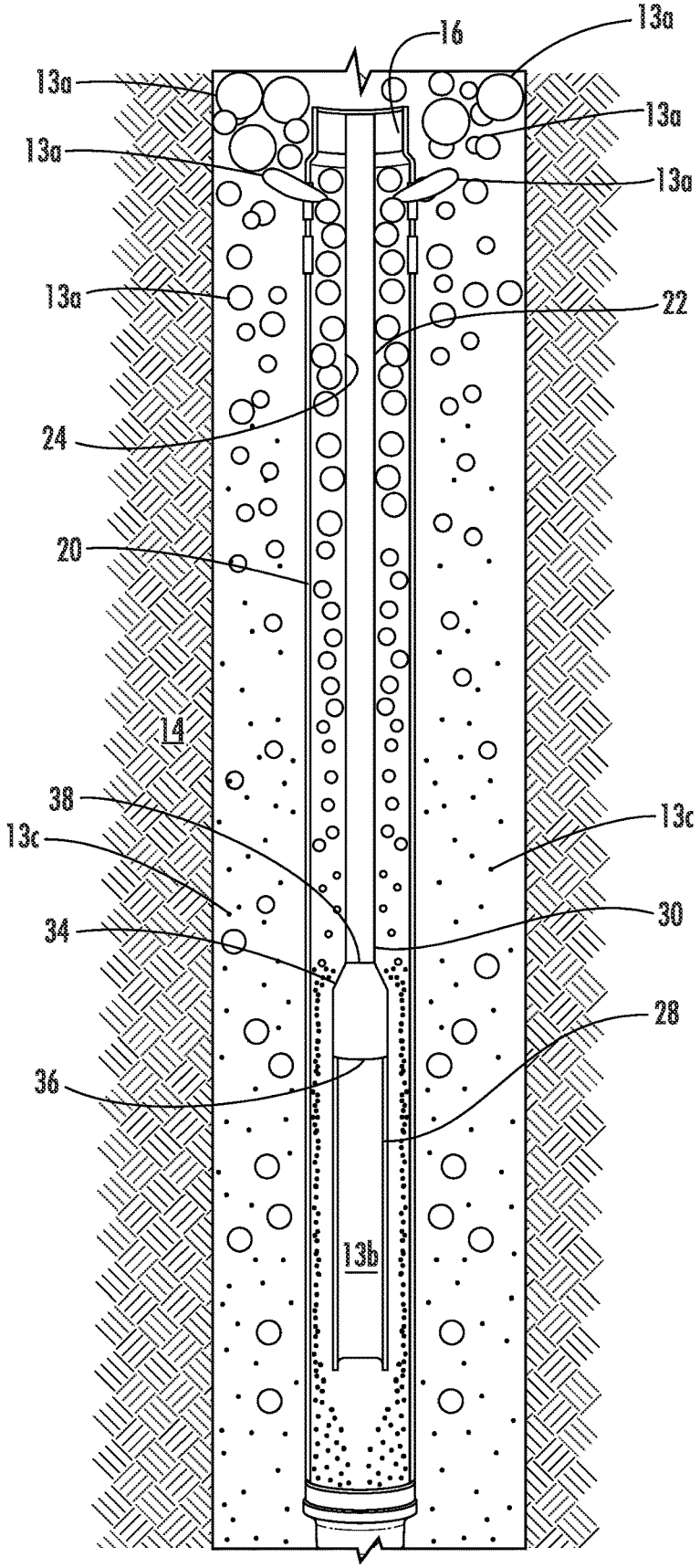
FIG. 3 is another partial cross-section and partial side elevation view of the downhole separator constructed in accordance with the present disclosure.

Referring now to the drawings, FIGS. 1-3 show a downhole separator 10 in a wellbore 12 where production materials, such as a three-phase fluid containing gases 13*a*, liquids 13*b* and solids 13*c*, can be produced from the surrounding formation 14. The wellbore 12 could also have casing (not shown) installed therein. The separator 10 can be in fluidic communication with a pump (not shown) that is used to pull liquids up from the wellbore 12 and through the separator 10. The liquid in the wellbore 12 typically includes gases and solids, such as sand, that can be harmful to the pump. The separator 10 is employed to remove the gases and solids from the liquid being drawn to the pump. In certain situations, the wellbore 12 can have casing (not shown) installed therein and the casing and formation 14 can be perforated to permit the production materials to flow into the wellbore 12.

The separator 10 includes an upper jacket 16 with radial directed ports 18 disposed therein to permit the three-phase fluid (liquid, gas and solids) to flow into the separator 10, a body 20 attached to the upper jacket 16, a dip tube 22 that extends at least partially through the body 20 and the upper jacket 18. The body 20 and the upper jacket 18 can be collectively referred to as the tubular body. The ports 18 are also designed to permit accumulated gases to flow out of the separator 10. In one embodiment, there is at least one uphole port 18*a* and at least one downhole port 18*b*. In one embodiment, there could be multiple uphole ports 18*s* and multiple downhole ports 18*b*. The dip tube 22 has a passageway 24 disposed therein that delivers the liquid/fluid to the pump. A first annulus area 26 is created between the body 20 and the dip tube 22. The first annulus area 26 is in fluid communication with the ports 18 disposed in the upper jacket 16.

In another embodiment, the separator 10 can include a shroud 28 supported on a downhole end 30 of the dip tube 22. A second annulus area 32 exists between the shroud 28 and the body 20 and is in fluid communication with the first annulus area 26. The shroud 28 is wider than the dip tube 22, which causes the first annulus area 26 to be wider than the second annulus area 32. The size differences (radial directed width) between the annulus areas 26 and 32 and the width differences (diameter) between the shroud 28 and the dip tube 22 contribute to the operational aspects of the separator 10. The separator 10 can also include an adapter 34 disposed between the shroud 28 and the dip tube 22. The adapter 34 can include a lower end 36 that can be threadably engaged with the shroud 18 and an upper end 38 that can be threadably engaged with the dip tube 22.

In another embodiment, the separator 10 can include lower jacket member 40 disposed on a downhole end 42 of the body 20. The lower jacket member 40 directs the solids separated out to a desired solids collector. The lower jacket member 40 can include an angled inner surface 42 to direct the solids downward in the separator 10.

The ports 18 in the upper jacket 16 can be sized and shaped such that the liquids, solids and gases can flow into the separator 10 via the ports 18, but also permit gases that enter the separator 10 to coalesce and flow back out of the separator 10. The gases that flow back out of the separator 10 via the ports 18 will flow uphole above the upper jacket 16 in the wellbore 12 to coalesce with any gases that did not flow into the separator 10. The shape of the ports 18 can be any shape such that the separator 10 works as desirable, such as square, rectangular, round, oval, oblong, and the like. The larger sized ports 18 allow the gas component to vent therethrough without breaking surface tension of the gas component bubbles. In one embodiment, the ports 18 are larger than about 0.5 inches across in any direction. In another embodiment, the ports 18 are larger than about 0.75 inches across in any direction. In yet another embodiment, the ports 18 are larger than about 1 inch across in any direction. In a further embodiment, the ports 18 are larger than about 1.25 inches across in any direction. In an even further embodiment, the ports 18 are larger than about 1.5 inches across in any direction.

The present disclosure is also directed to a method of separating the production materials with the downhole separator 10. In use, the production materials are pulled into the first annulus area 26 of the separator 10 via the ports 18. The separator 10 is set up such that the production materials flow through the first annulus area 26 at a velocity of less than about 0.5 ft per second. Pulling the production materials at a flow rate that causes the velocity of the production materials through the first annulus area 26 to be less than about 0.5 ft per second allows the gas component in the production materials to combine and flow upward and out of the separator 10 via the ports 18. Gas component bubbles will coalesce to form larger bubbles in the low velocity zone of the first annulus area 26.

The liquid and solid components of the production materials then flow from the first annulus area 26 to the second annulus area 32, which is narrower than the first annulus area 26. The narrower second annulus area 32 causes the velocity of the liquid component and the solid component of the production materials to increase in the second annulus area 32. The increased velocity through the second annulus area 32 creates an inertial effect, which causes the solid component to be forced in an outer radial direction in the separator 10.

The liquid component and the solid component, which is being forced outward, flow into an area below the shroud 18. The combination of the open area below the shroud 18, which causes the velocity of the liquid and solid component to slow down, the inertial flow effect and the increased velocity on the solid component of the production materials causes the solid component to continue past the bottom of the shroud 18 and separate from the liquid component. The liquid component is then pulled up into and through the shroud 18 and the dip tube 22 to the pump.

Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

What is claimed is:

1. A downhole separator for separating a three-phase fluid produced in an oil or gas well, the downhole separator comprising:

a tubular body;

a plurality of radial directed openings disposed in and about a circumference of an uphole end of the tubular body for allowing the three-phase fluid to enter the downhole separator while also permitting a gas component of the three-phase fluid to exit the downhole separator, the radial directed openings being square shaped and has side lengths larger than about 1.25 inches, at least two of the openings disposed on opposing sides of the uphole end of the tubular body;

a dip tube disposed inside the tubular body for delivering a primarily liquid component of the three-phase fluid to be processed, the downhole separator free of axially disposed tubing between the dip tube and the tubular body; and a first annulus area disposed between the dip tube and the tubular body.

2. The downhole separator of claim 1 further comprising a shroud disposed on a downhole end of the dip tube that is wider than the dip tube.

3. The downhole separator of claim 1 wherein the tubular body is comprised of a body portion and an upper jacket.

4. The downhole separator of claim 3 wherein the radial directed opening is in a sidewall of the upper jacket.

5. The downhole separator of claim 4 wherein the sidewall of the upper jacket is thicker than a sidewall of the body portion of the tubular body.

6. The downhole separator of claim 1 wherein the downhole separator includes multiple radial directed openings and the openings are included in an uphole series of radial directed openings in the uphole end of the tubular body and in a downhole series of radial directed openings in the uphole end of the tubular body.

7. The downhole separator of claim 6 wherein the uphole series of radial directed openings are in generally a first plane and the downhole series of openings are in generally a second plane.

8. A method of separating components of a three-phase fluid produced in an oil or gas well, the method comprising:

pumping the three-phase fluid into a downhole separator to separate the three-phase fluid into the separate components, the downhole separator comprises:

a tubular body;

a plurality of radial directed openings disposed in and about a circumference of an uphole end of the tubular body for allowing the three-phase fluid to enter the downhole separator while also permitting a gas component of the three-phase fluid to exit the downhole separator, the radial directed openings being square shaped and has side lengths larger than about 1.25 inches, at least two of the openings disposed on opposing sides of the uphole end of the tubular body;

a dip tube disposed inside the tubular body for delivering a primarily liquid component of the three-phase fluid from the oil or gas well, the downhole separator free of axially disposed tubing between the dip tube and the tubular body; and a first annulus area disposed between the dip tube and the tubular body where a gas component of the three-phase fluid is separated therefrom.

9. The method of claim 8 wherein the three-phase fluid is pumped through a part of the downhole separator at a velocity of less than 0.5 feet per second.

10. The method of claim 8 further comprising a shroud disposed on a downhole end of the dip tube that is wider than the dip tube.

11. The method of claim 8 wherein the tubular body is comprised of a body portion and an upper jacket.

12. The method of claim 11 wherein the radial directed opening is in a sidewall of the upper jacket.

13. The method of claim 12 wherein the sidewall of the upper jacket is thicker than a sidewall of the body portion of the tubular body.

14. The method of claim 8 wherein the downhole separator includes multiple radial directed openings and the openings are included in an uphole series of radial directed openings in the uphole end of the tubular body and in a downhole series of radial directed openings in the uphole end of the tubular body.

15. The method of claim 14 wherein the uphole series of radial directed openings are in generally a first plane and the downhole series of openings are in generally a second plane.

* * * * *